US005772090A

United States Patent [19]

Rodriguez

[11] Patent Number: 5,772,090

[45] Date of Patent: Jun. 30, 1998

[54] GOLF BALL CARRIER

[76] Inventor: Samuel I. Rodriguez, 1304 Five Star Blvd., Cottonwood, Ariz. 86326

[21] Appl. No.: 824,904

[22] Filed: Mar. 26, 1997

[51] Int. Cl.[6] ..... B60R 9/00

[52] U.S. Cl. ..... 224/251; 224/246; 224/918; 224/919; 206/315.9; 221/65; 221/307; D3/221; D3/229; D3/257

[58] Field of Search ..... 224/246, 251, 224/235, 242, 191, 918, 919, 148.5, 148.6; 206/315.1, 315.9; 221/64, 65, 307, 309, 310; 220/611, 754; 383/23, 24, 39, 118; 150/154; D3/229, 221, 257

[56] References Cited

U.S. PATENT DOCUMENTS 1,778,225 10/1930 Morss .
4,106,678 8/1978 Thomas .
4,678,108 7/1987 Inman .
4,840,332 6/1989 Hoyt .
5,186,374 2/1993 Buxton .

*Primary Examiner*—Henry J. Recla
*Assistant Examiner*—Gregory M. Vidovich
*Attorney, Agent, or Firm*—Joseph W. Mott

[57] ABSTRACT

Disclosed is a golf ball carrier for conveniently carrying and protecting a plurality of golf balls. A sleeve of padded material, open at both ends, has an elastic band at each end to retain the balls. A ball can be extracted by squeezing the sleeve above the ball, and balls can be inserted by pushing them past the band. The carrier may also incorporate holders for golf tees, and other items and a shoulder or belt strap and attachment clasp.

12 Claims, 1 Drawing Sheet

GOLF BALL CARRIER

FIELD OF THE INVENTION

This invention relates to the field of recreational or sports accessories, particularly for golfers.

BACKGROUND OF THE INVENTION

Golf balls are generally sold in packages of three balls, contained in cardboard boxes about 2 inches square and 5 inches long. Sometimes one face of the container is made of cellophane. Once opened, the box is an inconvenient carrying case, and balls are often tossed loose into a side pocket on a golf bag, the bottom of the golf bag, or a pocket in the golfer's clothing. It would be desirable to have a carrier for golf balls that affords easy insertion and removal of the balls, protects them from nicks or scratches, and may itself be stored in or on a golf bag or handily carried by the golfer.

Several approaches to golf ball carrier design have been developed. Some, such as those disclosed in U.S. Pat. Nos. 4,106,678 (Thomas), 4,678,108 (Inman), and 4,840,332 (Hoyt) employ a hard shell to contain and protect the balls. Thomas uses a plastic tube that holds the balls by the compressive force of the wall, and provides a pair of oppositely disposed arcuate openings at the bottom to allow the user's hand to force the bottom ball past a detente. Inman's design is also a plastic tube, but with a sight cut into the side for easy observation of the balls; the bottom of the tube, although open, does not permit passage of a ball and the top of the tube employs a flexible ring as a detente that can be overcome by exerting a small upward force on the ball. Hoyt uses a plastic tube in a C shape that has a diameter slightly smaller than that of a golf ball. The plastic is distorted slightly when a ball is inserted and the elastic pressure holds the ball in place until it is pushed out with slight pressure.

Both U.S. Pat. Nos. 5,186,374 (Buxton) and 1,778,225 (Morss) use fabric rather than plastic to hold the balls. Buxton discloses what is essentially an elongated padded pouch with one or more covered holes in the side through which balls may be pushed for insertion or removal. Morss discloses a canvas or rubber tube with structural integrity supplied by deformable rubber rings at each end that is adapted to be directly attached to the outside wall of a golf bag.

The hard-shelled carriers are subject to accidental breakage (by being stepped on or run over, for example) and to fatigue weakening of their elasticity and compressive strength as balls are repeatedly inserted and removed. They also might impart minuscule scratches on the ball, potentially affecting performance. Inman, which does not rely on gripping the ball in place, only allows access to the uppermost ball, requiring the user to remove and re-order the balls to get at the desired one. Buxton uses a padded fabric, but also contemplates access only to the topmost ball, and the suggestion that a series of covered holes be constructed adjacent to the positions of the balls as they rest stacked on each other leaves an awkward design. Morss discloses a rubber, canvas or leather tube attached to the side of a golf bag. Although this tube might be employed without attaching it to a golf bag, the tube wall probably would not afford much protection if the carrier were tossed about in a car trunk or golf bag, and it will likely collapse out of shape if it does not contain a full complement of balls. Moreover, the flanged rubber end rings or discs must be rigid enough to maintain their shape and supply the structural integrity needed for functionality, leading to a more costly design and one that does not lay relatively flat when empty. It is also somewhat difficult to attach the discs to the tube.

It would be advantageous to have a padded fabric carrier allowing ready removal from one end and insertion into the other end so that the fresh balls are pushed down until extracted, and either used balls or more new ones may handily be inserted into the top. Such a carrier could be constructed to resemble a small golf bag and to match the fabric and trim of the user's golf bag or apparel. It should be durable, protect the enclosed balls, and be inexpensive to manufacture.

SUMMARY OF THE INVENTION

Disclosed is a convenient protective carrier for golf balls, comprising a sleeve of padded fabric with a diameter slightly larger than a ball and a stretchable retaining strip across the top and bottom. The length of the sleeve may be sized to hold any desired number of balls, although carrying convenience suggests a 5" sleeve for 3 balls or an 8½" sleeve for 5 balls. Optionally, an attachment for holding tees and a ball marker can be incorporated, as well as a loop and clasp for attaching the carrier to the golfer's belt, the golf bag or the golf cart.

It is an object of the invention to provide a carrier for a plurality of golf balls that is convenient for transport while playing golf. It is a further object of the invention to construct the carrier so it protects the golf balls from scratches, nicks or dirt. Another object of the invention is to provide easy insertion and extraction of the balls, while retaining them securely when they are in the carrier. Still another object is to make the carrier itself easy to transport by incorporating a belt loop, hanger, clip or other mechanism. Another object is to provide an attractive configuration that mimics the shape of a golf bag, and which may be constructed to match the color and trim of the user's golf bag. A further object is to make the carrier a convenient holder for golf paraphernalia such as tees, ball markers and divot fixers. Other objects and advantages of this invention become apparent for the description to follow, particularly when read in conjunction with the accompanying drawings.

DETAILED DESCRIPTION OF THE INVENTION

Figure 1:
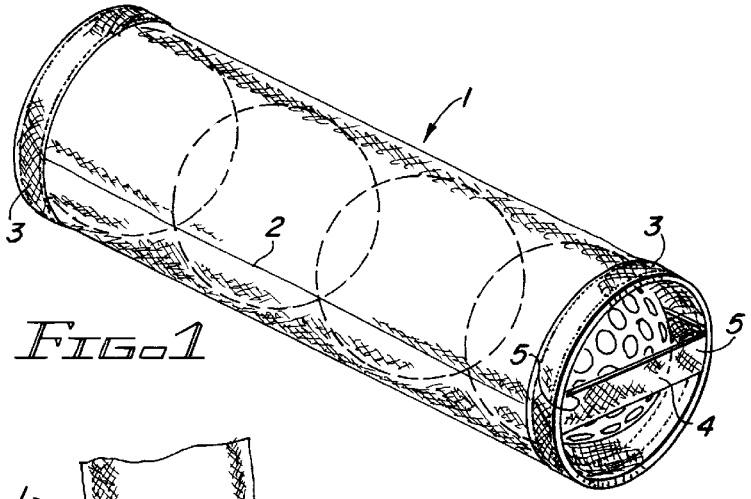
FIG. 1 is a view in perspective of a ball carrier embodying features of this invention.
Figure 2:
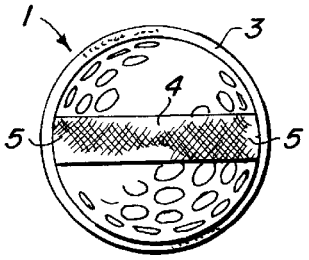
FIG. 2 is an end view of the carrier.

The invention will be described using the example of a carrier for five golf balls. The basic carrier is depicted in FIGS. 1 and 2. A fabric sleeve 1 with an inside diameter about the same as that of a golf ball (approximately 1.75 in.) is constructed from an appropriate padded fabric. In this example, the sleeve is fabricated of vinyl-back denier taffeta and formed from a rectangular piece joined with a sewn seam 2. The sleeve for five golf balls is approximately 8.5 in. long, and the openings at either end are stabilized and reinforced with standard nylon webbing fabric trim 3 stitched to the taffeta. A half-inch wide fabric-covered rubberized elastic band 4 is attached across each opening by sewing the ends 5 to the inside surface of the sleeve, and serves to prevent the balls from falling out of the carrier.

Balls may be inserted into the carrier by pushing them into the opening at either end. When the ball is pushed gently, the sleeve fabric distorts somewhat and the elastic band 4 stretches to the side to allow the ball to pass. Once the ball is past the elastic band, the band snaps back into place across the center of the opening, securing the ball.

Figure 3:
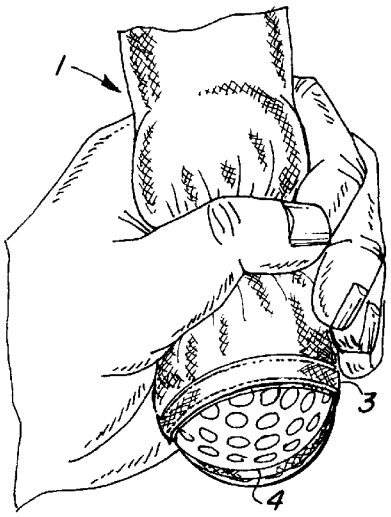
FIG. 3 is a depiction of the extraction of a ball from the carrier.

Extraction of a ball from the carrier is accomplished by squeezing the fabric between the ball nearest the opening and the ball adjacent thereto. As shown in FIG. 3, the pressure exerted forces the balls apart, pushing the lower ball against elastic band 4. The shape of sleeve 1 distorts and elastic band 4 stretches then slips to the side of the ball, allowing it to pass. Once the ball clears the elastic band, it is expelled into the user's hand and the band snaps back into place to retain any remaining balls.

Figure 4:
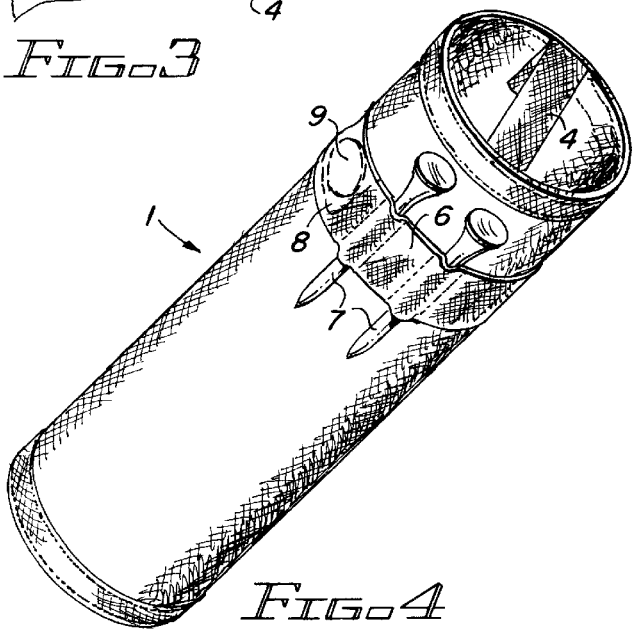
FIG. 4 is a drawing of the carrier as adapted to hold tees and a ball marker.
Figure 5:
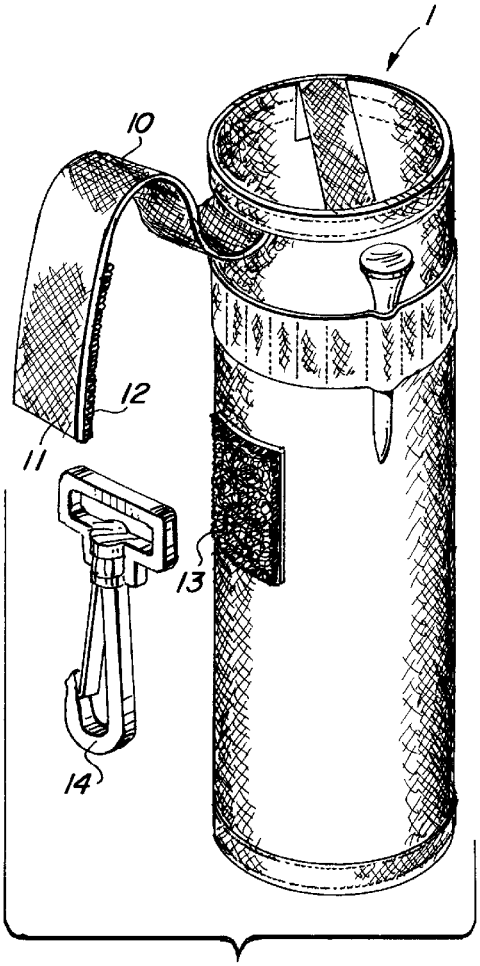
FIG. 5 is a drawing of the carrier with a belt loop and clasp attached.

The basic carrier may be enhanced by adding useful features, as shown on FIGS. 4 and 5. A strip of elastic fabric 6 attached around the outside of the carrier is suitable for holding a plurality of golf tees 7.

A portion of the band 6 may be attached so as to form a pocket 8 for secure retention of a ball marker 9. A hole in the band will accommodate the extension piece in a spike-type marker, and a flat marker will be snugly retained by the band.

A belt loop, clip or other convenient carrying mechanism may be incorporated into the device. One example is shown in FIG. 5. A length of nylon web strapping 10 is sewn at one end to the outside surface of sleeve 1. The free end 11 of strapping 10 has a fastening mechanism such as a snap or a Velcro hook and loop fastener strip 12. A receiving counterpart 13 of the fastening mechanism, such as a matching Velcro strip, is attached to the carrier, allowing the formation of a belt loop with the strapping. The closable loop thus formed may be attached to a variety of locations, including the handle of a golf cart or the rim of the steering wheel of a self-propelled golf cart. An optional clip 14 may be attached to strapping 10, offering additional ways that the carrier may be attached to the golf bag, golf cart or golfer.

Although the present invention has been described with reference to a particular version thereof, other versions are possible. For example, alternative materials such as fabric-lined closed cell neoprene, fabric-lined foam rubber, or a canvas shell with dense cotton padding. A pocket or a second circumferential elastic band could be incorporated for holding a score card, pencil, divot fixer, spike cleaner, ball brush, or other small items. An attached protective tube for carrying a cigar could be incorporated. A clip or ring could be attached at the top and bottom to accommodate an adjustable carrying strap, permitting the device to be worn over the shoulder or across the chest. Therefore, the spirit and scope of the appended claims should not be limited to the description of the versions contained herein.

I claim:

1. A golf ball carrier for transporting a plurality of golf balls comprising a sleeve of padded fabric having a diameter slightly greater than that of a golf ball and having first and second open ends; and elastic retaining bands attached to the sleeve and respectively positioned across the center of each of the open ends so as to retain golf balls when placed in the sleeve.

2. The carrier of claim 1 further including an attachment adapted to holding golf tees.

3. The carrier of claim 1 further including at least one pocket for carrying small items.

4. The carrier of claim 1 further including a means for attaching the carrier to a user's belt.

5. The carrier of claim 1 further including an attached clasp.

6. A golf ball carrier for transporting a plurality of golf balls comprising a sleeve of padded fabric having a diameter slightly greater than that of a golf ball and having first and second open ends; a reinforcing fabric trim attached at either end; an elastic retaining band at each open end attached to the sleeve and positioned across the center of each open end so as to retain golf balls when placed in the sleeve; a means for attaching the carrier to a belt; an attachment adapted to hold a plurality of golf tees; and a clasp.

7. The carrier of claim 6 wherein the padded fabric is vinyl-backed taffeta denier.

8. The carrier of claim 6 wherein the padded fabric is fabric-lined closed cell neoprene.

9. The carrier of claim 6 wherein the padded fabric is fabric-lined foam rubber.

10. A golf ball carrier for transporting a plurality of golf balls comprising a sleeve of padded fabric having a diameter slightly greater than that of a golf ball and having at least one open end; an elastic retaining band attached to the sleeve and positioned across the center of the open end so as to retain golf balls when placed in the sleeve; an attached fabric strip adapted to hold golf tees; and an attached pocket for carrying small items.

11. The carrier of claim 10 further including a means for attaching the carrier to a user's belt.

12. The carrier of claim 10 further including an attached clasp.

* * * * *